US010242638B2

(12) United States Patent
Liang et al.

(10) Patent No.: US 10,242,638 B2
(45) Date of Patent: Mar. 26, 2019

(54) DISPLAY ADJUSTING DEVICE, POWER SOURCE CIRCUIT, DISPLAY DEVICE AND DISPLAY ADJUSTING METHOD

(71) Applicants: BOE TECHNOLOGY GROUP CO., LTD., Beijing (CN); CHONGQING BOE OPTOELECTRONICS TECHNOLOGY CO., LTD., Chongqing (CN)

(72) Inventors: Lisheng Liang, Beijing (CN); Yihjen Hsu, Beijing (CN); Lijun Xiao, Beijing (CN); Shuai Hou, Beijing (CN); Fei Shang, Beijing (CN); Xianyong Gao, Beijing (CN); Shuai Chen, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 122 days.

(21) Appl. No.: 15/291,562

(22) Filed: Oct. 12, 2016

(65) Prior Publication Data

US 2017/0132986 A1 May 11, 2017

(30) Foreign Application Priority Data

Nov. 5, 2015 (CN) ..... 2015 1 0745288

(51) Int. Cl.
*G09G 3/36* (2006.01)

(52) U.S. Cl.
CPC ..... *G09G 3/3696* (2013.01); *G09G 3/3677* (2013.01); *G09G 2310/0286* (2013.01); *G09G 2320/0673* (2013.01)

(58) Field of Classification Search
CPC ..... G09G 3/3696; G09G 3/3677; G09G 2320/0673; G09G 2310/0286
See application file for complete search history.

(56) References Cited

U.S. PATENT DOCUMENTS

2013/0088477 A1* 4/2013 Seong ..... G09G 1/005 345/211
2015/0145758 A1* 5/2015 Lee ..... G09G 3/3648 345/87

* cited by examiner

*Primary Examiner* — Vinh T Lam
(74) *Attorney, Agent, or Firm* — Brooks Kushman P.C.

(57) ABSTRACT

A display adjusting device, a power source circuit, a display device and a display adjusting method are provided. The display adjusting device includes a start signal detection unit, configured to, in a case that a gate drive circuit including multiple stages of gate drive circuit units scans multiple rows of gate lines arranged in the display panel, detect a gate drive signal outputted by a last row of shift register unit included in each stage of gate drive circuit unit, where the gate drive signal serves as a start signal of a next stage of gate drive circuit unit adjacent to the stage of gate drive circuit unit, and a gamma main voltage setting unit, configured to set a corresponding gamma main voltage based on the start signal.

15 Claims, 3 Drawing Sheets

DISPLAY ADJUSTING DEVICE, POWER SOURCE CIRCUIT, DISPLAY DEVICE AND DISPLAY ADJUSTING METHOD

CROSS-REFERENCE TO RELATED APPLICATIONS

This application claims priority to Chinese Patent Application No. 201510745288.X filed on Nov. 5, 2015, the disclosure of which is incorporated in its entirety by reference herein.

TECHNICAL FIELD

The present disclosure relates to the field of display technology, and in particular to a display adjusting device, a power source circuit, a display device and a display adjusting method.

BACKGROUND

In related technologies, a display device includes a display panel, a gate drive circuit and a power source circuit. The gate drive circuit is configured to scan multiple rows of gate lines arranged in the display panel. A gate drive circuit included in a display device with a high resolution includes at least two stages of gate drive circuit units arranged in sequence along a longitudinal direction from the top to the bottom of a lateral edge of the display panel. Each stage of gate drive circuit unit is equipped with a gate driver integrated circuit (Gate driver IC), and different Gate driver ICs may be fabricated at different times and even by different factories. An image displayed on the display panel is very sensitive to an output voltage from the Gate driver IC. An error between output voltages from same Gate driver ICs is not so large, but an error between output voltages from different Gate driver ICs may be large. In this case, a deficient image having lateral blocks may be displayed on the display panel.

In the related technologies, the power source circuit can be configured to output only one gamma main voltage AVDD. In consideration of the deficiency of lateral blocks, the power source circuit can only output a gamma main voltage AVDD to alleviate such deficiency, but cannot provide corresponding gamma main voltages AVDDs to different regions scanned by different gate drive circuit units; hence, the deficiency of lateral screen-splitting of the display panel caused by different gate drive circuit units or caused by other factors cannot be overcome. Since it is impossible to provide corresponding AVDDs to regions scanned by different Gate driver ICs, it is impossible to generate a corresponding gamma reference voltage to drive liquid crystals to rotate. Therefore, it is difficult to dynamically adjust the gamma voltage and alleviate the deficiency of lateral screen-splitting.

SUMMARY

The present disclosure provides a display adjusting device, a power source circuit, a display device and a display adjusting method to address the deficiency of lateral screen-splitting of display panel caused by different gate drive circuit units or caused by other factors in the related technologies.

The present disclosure provides a display adjusting device for adjusting displaying of the display panel. The display adjusting device includes: a start signal detection unit, configured to, in a case that a gate drive circuit including multiple stages of gate drive circuit units scans multiple rows of gate lines arranged in the display panel, detect a gate drive signal outputted by a last row of shift register units included in each stage of gate drive circuit unit, where the gate drive signal serves as a start signal of a next stage of gate drive circuit unit adjacent to the stage of gate drive circuit unit; and a gamma main voltage setting unit, configured to set a corresponding gamma main voltage based on the start signal.

In an implementation, the display adjusting device according to the present disclosure may further include: multiple start signal detection lines each connected to the start signal detection unit. The start signal detection unit is configured to detect gate drive signal outputted by last rows of shift register units included in respective stages of gate drive circuit units via the multiple start signal detection lines.

In an implementation, each stage of gate drive circuit unit may include a left side gate drive sub-circuit and a right side gate drive sub-circuit, having a same structure and respectively arranged on two lateral edges of the display panel, the left side gate drive sub-circuit included in the stage of gate drive circuit unit may be configured to output a first start signal to the left side gate drive sub-circuit included in a next stage of gate drive circuit unit adjacent to the stage of gate drive circuit unit, the right side gate drive sub-circuit included in the stage of gate drive circuit unit may be configured to output a second start signal to the right side gate drive sub-circuit included in the next stage of gate drive circuit adjacent to the stage of gate drive circuit unit, the start signal detection unit is configured to detect the first start signal and the second start signal when the gate drive circuit scans the multiple rows of gate lines arranged in the display panel; and the gamma main voltage setting unit is configured to set the corresponding gamma main voltage based on the first start signal and the second start signal.

In an implementation, start signal transmission lines may be arranged between each stage of gate drive circuit unit and a next stage of gate drive circuit unit adjacent to the stage of gate drive circuit and between a last stage of gate drive circuit unit and a first stage of gate drive circuit.

In an implementation, the first start signal outputted by the left side gate drive sub-circuit included in each stage of gate drive circuit unit may be same as the second start signal outputted by the right side gate drive sub-circuit of the stage of gate drive circuit unit.

The present disclosure further provides a power source circuit including any one of the above display adjusting devices.

The present disclosure may further provide a display device including a display panel, a gate drive circuit and a power source circuit. The gate drive circuit is configured to scan multiple rows of gate lines arranged in the display panel and includes at least two stages of gate drive circuit units arranged in sequence along a longitudinal direction from the top to the bottom of a lateral edge of the display panel, and the power source circuit includes a display adjusting device. The display adjusting device includes: a start signal detection unit, configured to configured to, in a case that the gate drive circuit scans the multiple rows of gate lines arranged in the display panel, detect a gate drive signal outputted by a last row of shift register unit included in each stage of gate drive circuit unit, where the gate drive signal serves as a start signal of a next stage of gate drive circuit unit adjacent to the stage of gate drive circuit unit; and a gamma main voltage setting unit, configured to set a corresponding gamma main voltage based on the start signal.

In an implementation, the display adjusting device may further include: multiple start signal detection lines that are connected to the start signal detection unit and are connected to last rows of shift register units included in respective stages of gate drive circuit units. The start signal detection unit is configured to detect, via the multiple start signal detection lines, gate drive signals outputted by the last rows of shift register units included in the respective stages of gate drives circuit units.

In an implementation, each stage of gate drive circuit unit may include a left side gate drive sub-circuit and a right side gate drive sub-circuit, having a same structure and respectively arranged on two lateral edges of the display panel. The left side gate drive sub-circuit included in the stage of gate drive circuit unit may be configured to output a first start signal to the left side gate drive sub-circuit included in a next stage of gate drive circuit unit adjacent to the stage of gate drive circuit. The right side gate drive sub-circuit included in the stage of gate drive circuit unit may be configured to output a second start signal to the right side gate drive sub-circuit included in the next stage of gate drive circuit unit adjacent to the stage of gate drive circuit unit. The start signal detection unit may be configured to detect the first start signal and the second start signal when the gate drive circuit scans the rows of gate lines arranged in the display panel. The gamma main voltage setting unit is configured to set the corresponding gamma main voltage based on the first start signal and the second start signal.

In an implementation, the display device in the present disclosure may include a source drive circuit; where the source drive circuit includes a gamma reference voltage generation unit configured to generate a gamma reference voltage based on the gamma main voltage.

The present disclosure may further provide a display adjusting method applied in the above described display device. The display adjusting method includes: scanning, by the gate drive circuit, the multiple rows of gate lines arranged in the display panel, and detecting, by the start signal detection unit, the gate drive signal outputted by the last row of shift register unit included in each stage of gate drive circuit unit, where the gate drive signal serves as the start signal of the next gate drive circuit unit adjacent to the stage of gate drive circuit unit; and setting, by the gamma main voltage setting unit, the corresponding gamma main voltage based on the start signal.

In an implementation, the display adjusting method in the present disclosure may further include: generating, by a source drive circuit, a gamma reference voltage based on the gamma main voltage.

In an implementation, the step of scanning, by the gate drive circuit, the rows of gate lines arranged in the display panel may include: when the gate drive circuit scans a last row of gate lines arranged in the display panel, outputting the gate drive signal from the last row of shift register unit included in a last stage of gate drive circuit unit to a first stage of gate drive circuit unit as the start signal of the first stage of gate drive circuit unit.

In an implementation, each stage of gate drive circuit unit may include a left side gate drive sub-circuit and a right side gate drive sub-circuit, having a same structure and respectively arranged on two lateral edges of the display panel, the left side gate drive sub-circuit included in the stage of gate drive circuit unit may be configured to output a first start signal to the left side gate drive sub-circuit included in a next stage of gate drive circuit unit adjacent to the stage of gate drive circuit, the right side gate drive sub-circuit included in the stage of gate drive circuit unit may be configured to output a second start signal to the right side gate drive sub-circuit included in the next stage of gate drive circuit unit adjacent to the stage of gate drive circuit. The step of detecting, by the start signal detection unit, the gate drive signal outputted by the last row of shift register unit included in each stage of gate drive circuit may include: detecting, by the start signal detection unit, the first start signal outputted from the left side gate drive sub-circuit included in the stage of gate drive circuit unit to the left side gate drive sub-circuit included in the next stage of gate drive circuit unit adjacent to the stage of gate drive circuit unit and the second start signal outputted from the right side gate drive sub-circuit included in the stage of gate drive circuit unit to the right side gate drive sub-circuit included in the next stage of gate drive circuit unit adjacent to the stage of gate drive circuit unit. The step of setting, by the gamma main voltage setting unit, the corresponding gamma main voltage based on the start signal may include: setting, by the gamma main voltage setting unit, the corresponding gamma main voltage based on the first start signal and the second start signal.

As compared with the related technologies, with the display adjusting device, the power source circuit, the display device and the display adjusting method according the present disclosure, the start signal detection unit detects the start signal outputted by the last row of shift register unit included in each stage of gate drive circuit unit, the gamma main voltage setting unit sets the corresponding gamma main voltage based on the start signal, so as to provide corresponding gamma main voltages AVDDs to regions scanned by different gate drive circuit units, thereby overcoming the deficiency of lateral screen-splitting of display panel caused by different gate drive circuit units or caused by other factors.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Technical solutions of the present disclosure will be described hereinafter in a clear and complete manner in conjunction with the drawings and embodiments. Obviously, the following embodiments are merely a part of, rather than all of, the embodiments of the present disclosure, and based on these embodiments, a person skilled in the art may obtain other embodiments, which also fall within the scope of the present disclosure.

Figure 1:
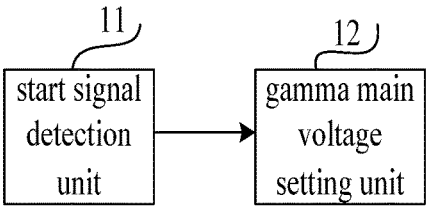
FIG. 1 is a schematic structural diagram of a display adjusting device according to some embodiments of the present disclosure.

As shown in FIG. 1, the present disclosure provides in some embodiments a display adjusting device, to adjust displaying of a display panel. The display adjusting device includes a start signal detection unit 11 and a gamma main voltage setting unit 12.

The start signal detection unit 11 is configured to, in a case that a gate drive circuit including multiple stages of gate drive circuit units scans multiple rows of gate lines arranged in the display panel, detect a gate drive signal outputted by a last row of shift register unit included in each stage of gate drive circuit unit, where the gate drive signal serves as a start signal of a next stage of gate drive circuit unit adjacent to the stage of gate drive circuit unit.

The gamma main voltage setting unit 12 is connected to the start signal detection unit 11 and is configured to set a corresponding gamma main voltage based on the start signal. In the display adjusting device in the embodiments of the present disclosure, the start signal outputted by the last row of shift register unit included in each stage of gate drive circuit unit is detected by the start signal detection unit, and the gamma main voltage is set by the gamma main voltage setting unit based on the start signal, so as to provide gamma main voltages AVDDs to regions scanned by different gate drive circuit units, thereby overcoming the deficiency of lateral screen-splitting of display panel caused by different gate drive circuit units or caused by other factors.

Optionally, the display adjusting device according embodiments of the present disclosure may further include start signal detection lines connected to the start signal detection unit.

The start signal detection unit detects gate drive signals outputted by last rows of shift register units included in respective gate drive circuit units with the start signal detection lines.

In actual implementation, start signal transmission lines may be arranged between each stage of gate drive circuit unit and a next stage of gate drive circuit unit and between a last stage of gate drive circuit unit and a first stage of gate drive circuit unit. In the display adjusting device in the embodiments of the present disclosure, the start signal detection lines are arranged to connect the start signal transmission lines to the start signal detection unit. Hence, it is convenient for the start signal detection unit to detect the start signals.

In the display adjusting device in some embodiments of the present disclosure, in a case that each stage of gate drive circuit unit includes a left side gate drive sub-circuit and a right side gate drive sub-circuit having a same structure and respectively arranged on two lateral edges of the display panel, the left gate drive sub-circuit outputs a first start signal to a left side gate drive sub-circuit included in a next stage of gate drive circuit unit adjacent to the stage of gate drive circuit unit, and the right side gate drive sub-circuit outputs a second start signal to a right side gate drive sub-circuit included in the next stage of gate drive circuit unit adjacent to the stage of gate drive circuit unit. The start signal detection unit is configured to detect the first start signal and the second start signal when the gate drive circuit scans multiple rows of gate lines arranged in the display panel.

The gamma main voltage setting unit is configured to set a gamma main voltage based on the first start signal and the second start signal.

In actual implementation, in a case that the gate drive circuit is a bilateral gate drive circuit, that is, each stage of gate drive circuit unit includes a left side gate drive sub-circuit and a right side gate drive sub-circuit having a same structure and respectively arranged on two lateral edges of the display panel, generation of the start signals may have the following two cases.

In a first case, a start signal received by each stage of left side gate drive sub-circuit is same as a start signal received by the same stage of right side gate drive sub-circuit. In this case, the display adjusting device is same as a display adjusting device for a display panel of which a single side is arranged with a gate drive circuit.

In a second case, a start signal received by each stage of left side gate drive sub-circuit is different from a start signal received by the same stage of right side gate drive sub-circuit. In this case, the display adjusting device in the above embodiments is adopted, in which the start signal detection unit detects the first start signal and the second start signal, and the gamma main voltage setting unit sets a gamma main voltage based on the first start signal and the second start signal.

In some embodiments of the present disclosure, a power source circuit may include the above display adjusting device. That is, in actual implementation, the display adjusting device in the embodiments of the present disclosure may be contained in the power source circuit of a display device. In other words, the start signal detection unit and the gamma main voltage setting unit included in the display adjusting device are both arranged in the power source circuit. The start signal detection unit detects a start signal transmitted between every two adjacent stages of gate drive circuit units and the gamma main voltage setting unit sets a corresponding gamma main voltage based on the start signal, such that corresponding gamma main voltages AVDDs are provided to regions scanned by different gate drive circuit units. Hence, the deficiency of lateral screen-splitting of display panel caused by different gate drive circuit units or caused by other factors is overcome.

The present disclosure provides, in some embodiments, a display device including a display panel, a gate drive circuit and a power source circuit. The gate drive circuit is configured to scan multiple rows of gate lines arranged in the display panel, and includes at least two stages of gate drive circuit units arranged in sequence along a longitudinal direction from the top to the bottom of a lateral edge of the display panel. The power source circuit includes a display adjusting device.

The display adjusting device includes:

a start signal detection unit, configured to, in a case that the gate drive circuit scans the multiple rows of gate lines arranged in the display panel, detect a gate drive signal outputted by a last row of shift register unit included in each stage of gate drive circuit unit, where the gate drive signal serves as a start signal of a next stage of gate drive circuit unit adjacent to the stage of gate drive circuit unit; and a gamma main voltage setting unit, configured to set a corresponding gamma main voltage based on the start signal.

The display adjusting device is adopted in the power source circuit included in the display device in the embodiments of the present disclosure. In the display adjusting device, the start signal outputted by the last row of shift register unit included in each stage of gate drive circuit unit is detected by the start signal detection unit, and the corresponding gamma main voltage is set by the gamma main voltage setting unit based on the start signal, such that corresponding gamma main voltages AVDDs are provided to regions scanned by different drive circuit units, thereby overcoming the deficiency of lateral screen-splitting of display panel coursed by different gate drive circuit units or caused by other factors.

Optionally, the display adjusting device may further include start signal detection lines that are connected to the start signal detection unit and are connected to last rows of shift register units included in the respective gate drive circuit units.

The start signal detection unit is configured to detect gate drive signals outputted by last rows of shift register units included in the respective gate drive circuit units via the start signal detection lines.

In actual implementation, start signal transmission lines are arranged between each stage of gate drive circuit unit and a next stage of gate drive circuit unit adjacent to the stage of gate drive circuit unit and between a last stage of gate drive circuit unit and a first stage of gate drive circuit unit. In the display adjusting device in the embodiments of the present disclosure, the start signal detection lines are arranged to connect the start signal transmission lines to the start signal detection unit. Hence, it is convenient for the start signal detection unit to detect the start signals.

In a display device in some embodiments of the present disclosure, each stage of gate drive circuit unit may include a left side gate drive sub-circuit and a right side gate drive sub-circuit having a same structure and respectively arranged on two lateral edges of the display panel.

The left side gate drive sub-circuit may be configured to output a first start signal to a left side gate drive sub-circuit included in a next stage of gate drive circuit unit adjacent to the stage of gate drive circuit unit.

The right side gate drive sub-circuit is configured to output a second start signal to a right side gate drive sub-circuit included in a next stage of gate drive circuit unit adjacent to the stage of gate drive circuit unit.

The start signal detection unit is configured to detect the first start signal and the second start signal when the gate drive circuit scans the multiple rows of gate lines arranged in the display panel.

The gamma main voltage setting unit is configured to set a corresponding gamma main voltage based on the first start signal and the second start signal.

In the display device in the present disclosure, the start signal detection unit detects a first start signal transmitted between adjacent stages of left side gate drive sub-circuits and a second start signal transmitted between adjacent stages of right side gate drive sub-circuits, and a corresponding gamma main voltage is set by the gamma main voltage setting unit based on the first start signal and the second start signal. In this case, the deficiency of lateral screen-splitting of display panel caused by different gate drive circuit units or caused by other factors can be solved even if the first start signal is different from the second start signal.

The display device in the embodiments of the present disclosure may further include a source drive circuit.

The source drive circuit includes a gamma reference voltage generation unit configured to generate a gamma reference voltage based on the gamma main voltage.

In a case that the display device is a liquid crystal display device, the source drive circuit generates the gamma reference voltage based on the gamma main voltage AVDD to drive liquid crystals to rotate, thereby dynamically adjusting the gamma voltage and eliminating the lateral screen-splitting.

In the following, the display device according to the present disclosure is described in detail.

Figure 2:
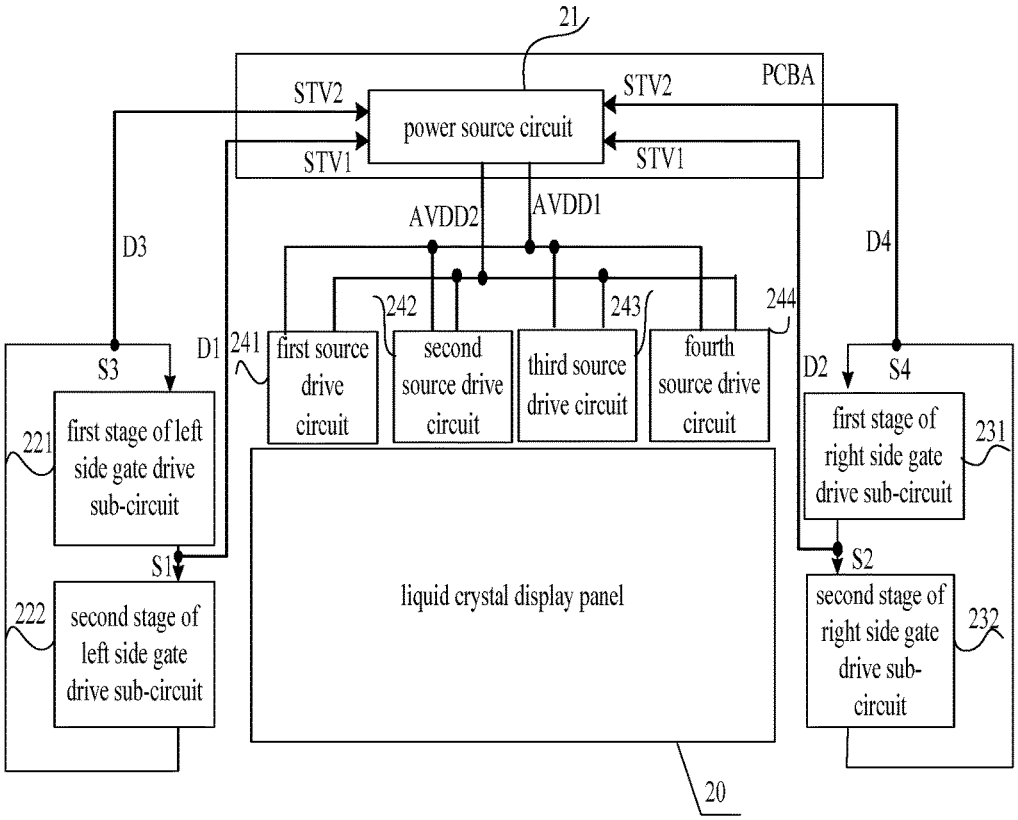
FIG. 2 is a schematic structural diagram of a display device according to some embodiments of the present disclosure.

As shown in FIG. 2, a display device in some embodiments of the present disclosure includes a liquid crystal display panel 20, a power source circuit 21, a first stage of left side gate drive sub-circuit 221, a second stage of left side gate drive sub-circuit 222, a first stage of right side gate drive sub-circuit 231, a second stage of right side gate drive sub-circuit 232, a first source drive circuit 241, a second source drive circuit 242, a third source drive circuit 243 and a fourth source drive circuit 244. The power source circuit 21 is arranged on a printed circuit board (PCBA). The first stage of left side gate drive sub-circuit 221 and the second stage of left side gate drive sub-circuit 222 are arranged downwardly along a left lateral edge of the liquid crystal display panel 20. The first stage of right side gate drive sub-circuit 231 and the second stage of right side gate drive sub-circuit 232 are arranged downwardly along a right lateral edge of the display panel 20. The first source drive circuit 241, the second source drive circuit 242, the third source drive circuit 243 and the fourth electrode drive circuit 244 are arranged in sequence from left to right along an upper edge of the display panel 20. It should be noted that, in the display device of the embodiments, it is taken as an example that a start signal received by each stage of left side gate drive sub-circuit is same as a start signal received by the same stage of right side gate drive sub-circuit.

A first start signal transmission line S1 is arranged between the first stage of left side gate drive sub-circuit 221 and the second stage of left side gate drive sub-circuit 222, and is connected to the power source circuit 21 via a first start signal detection line D1. The first stage of left side gate drive sub-circuit 221 feeds a start signal STV1 back to the power source circuit 21 via the first start signal detection line D1 while transmitting the start signal STV1 to the second stage of left side gate drive sub-circuit 222 via the first start signal transmission line S1.

A second start signal transmission line S2 is arranged between the first stage of right side gate drive sub-circuit 231 and the second stage of right side gate drive sub-circuit 232, and is connected to the power source circuit 21 via a second start signal detection line D2. The first stage of right side gate drive sub-circuit 231 feeds a start signal STV1 back to the power source circuit 21 via the second start signal detection line D2 while transmitting the start signal STV1 to the second stage of right side gate drive sub-circuit 232 via the second start signal transmission line S2.

Figure 5:
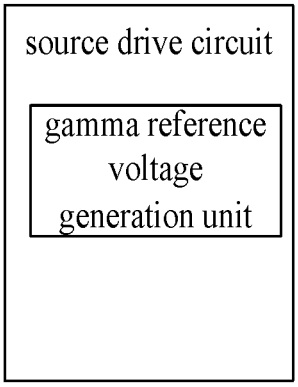
FIG. 5 is a block diagram of a structure of a gamma reference voltage generation unit included in a source drive circuit according to some embodiments of the present disclosure.

In the embodiments, the power source 21 sets a first gamma main voltage AVDD1 for the second stage of left side gate drive sub-circuit 222 and the second stage of right side gate drive sub-circuit 232 based on the start signal STV1. The first gamma main voltage AVDD1 depends on an actual debug result. The newly-set first gamma main voltage AVDD1 is output to a gamma reference voltage generation circuit (as shown in FIG. 5) included in the first source drive circuit 241, a gamma reference voltage generation circuit included in the second source drive circuit 242, a gamma reference voltage generation circuit included in the third source drive circuit 243 and a gamma reference voltage generation circuit included in the fourth source drive circuit 244, to drive liquid crystals to rotate, thereby dynamically adjusting gamma voltages.

A third start signal transmission line S3 is arranged between the second stage of left side gate drive sub-circuit 222 and the first stage of left side gate drive sub-circuit 221, and is connected to the power source circuit 21 via a third start signal detection line D3. The second stage of left side gate drive sub-circuit 222 feeds a start signal STV2 back to the power source circuit 21 via the third start signal detection line D3 while transmitting the start signal STV2 to the first stage of left side gate drive sub-circuit 221 via the third start signal transmission line S3.

A fourth start signal transmission line S4 is arranged between the second stage of right side gate drive sub-circuit 232 and the first stage of right side gate drive sub-circuit 231, and is connected to the power source circuit 21 via a fourth start signal detection line D4. The second stage of right side gate drive sub-circuit 232 feeds a start signal STV2 back to the power source circuit 21 via the fourth start signal detection line D4 while transmitting the start signal STV2 to the first stage of right side gate drive sub-circuit 231 via the fourth start signal transmission line S4.

In the embodiments of the present disclosure, the power source circuit 21 sets a second gamma main voltage AVDD2 for the second stage of left side gate drive sub-circuit 222 and the second stage of right side gate drive sub-circuit 232 based on the start signal STV2, and the second gamma main voltage AVDD2 depends on an actual debugging result. The newly-set second gamma main voltage AVDD2 is outputted to the gamma reference voltage generation circuit (as shown in FIG. 5) included in the first source drive circuit 241, the gamma reference voltage generation circuit included in the second source drive circuit 242, the gamma reference voltage generation circuit included in the third source drive circuit 243 and the gamma reference voltage generation circuit included in the fourth source drive circuit 244, to drive liquid crystals to rotate, thereby dynamically adjusting gamma voltages.

Figure 3:
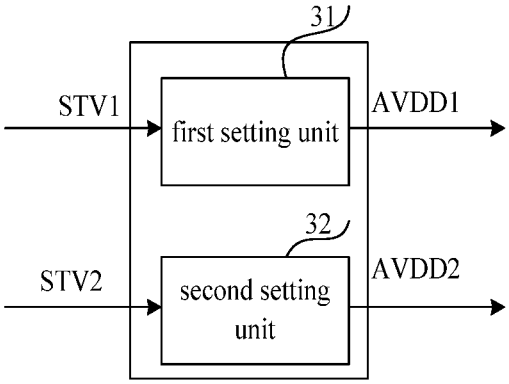
FIG. 3 is a block diagram of a structure of a source driver included in a display device according to some embodiments of the present disclosure.

As shown in FIG. 3, a gamma voltage setting unit of a display adjusting device included in the power source circuit includes a first setting unit 31 and a second setting unit 32.

The first setting unit 31 is configured to convert the start signal STV1 into the first gamma main voltage AVDD1.

The second setting unit 32 is configured to convert the start signal STV2 into the second gamma main voltage AVDD2.

When the liquid crystal display panel displays one frame of image, the gate drive circuit outputs an appropriate on-voltage or off-voltage to specified scanning lines sequentially. The start signal transmitted between adjacent stages of gate drive circuit units is fed back to the power source circuit. The power source circuit outputs a newly-set gamma main voltage AVDD after receiving the start signal, and the gamma main voltage AVDD is for generating a gamma reference voltage. In consideration of the deficiency of lateral screen-splitting of the liquid crystal display panel caused by different outputs from different stages of gate drive circuit units or caused by other factors, with the display device in the embodiments of the present disclosure, corresponding gamma main voltages AVDDs are provided to regions scanned by different gate drive circuit units, and gamma reference voltages are generated by source drive circuits to drive liquid crystals to rotate, thereby dynamically adjusting the gamma voltages and eliminating the deficiency of lateral screen-splitting.

Figure 4:
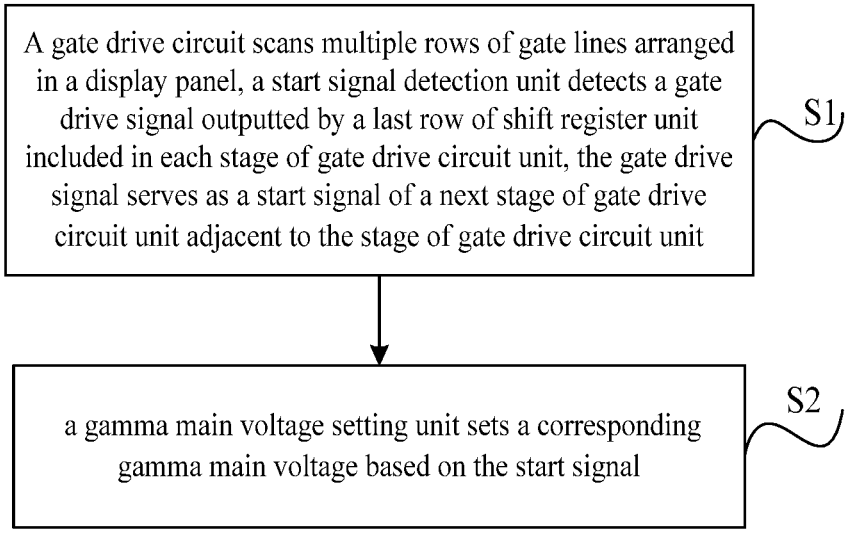
FIG. 4 is a flowchart of a display adjusting method according to some embodiments of the present disclosure.

As shown in FIG. 4, the present disclosure provides, according to some embodiments, a display adjusting method that is applied in the above display device. The display adjusting method includes step S1 and step S2.

In step S1, a gate drive circuit including multiple stages of gate drive circuit units scans multiple rows of gate lines arranged in a display panel, a start signal detection unit detects a gate drive signal outputted by a last row of shift register unit included in each stage of gate drive circuit unit. The gate drive signal serves as a start signal of a next stage of gate drive circuit unit adjacent to the stage of gate drive circuit.

In step S2, a corresponding gamma main voltage is set by a gamma main voltage setting unit based on the start signal.

The display adjusting method in the embodiments of the present disclosure further includes: generating, by a source drive circuit, a gamma reference voltage based on the gamma main voltage.

In the display adjusting method in the embodiments of the present disclosure, the start signal outputted by the last row of shift register unit included in each stage of gate drive circuit unit is detected by the start signal detection unit, and the corresponding gamma main voltage is set by the gamma main voltage setting unit based on the start signal. In this case, corresponding gamma main voltages AVDDs are provided to regions scanned by different gate drive circuit units, thereby overcoming the deficiency of lateral screen-splitting of display panel caused by different gate drive circuit units or caused by other factors.

The step of scanning the multiple rows of gate lines on the display panel by the gate drive circuit may further include: outputting a gate drive signal outputted by a last row of shift register unit of a last stage of gate drive circuit unit to a first stage of shift register unit as a start signal of the first stage of shift register unit, when the gate drive circuit scans a last row of gate line on the display panel; and scanning a first row of gate line after the last row of gate line on the display panel is scanned. Each time after the last row of gate line is scanned, the gate drive signal outputted by the last row of shift register unit of the last stage of gate drive circuit unit serves as a start signal of the first stage of gate drive circuit unit and the first row of gate line is then scanned.

In the display adjusting method in some embodiments of the present disclosure, in a case that each stage of gate drive circuit unit includes a left side gate drive sub-circuit and a right side gate drive sub-circuit having a same structure and respectively arranged at two lateral edges of the display panel, the left side gate drive sub-circuit is configured to output a first start signal to a left side gate drive sub-circuit included in a next stage of gate drive circuit unit adjacent to the stage of gate drive circuit unit, and the right side gate drive sub-circuit is configured to output a second start signal to a right side gate drive sub-circuit included in a next stage of gate drive circuit unit adjacent to the stage of gate drive circuit unit. The step in which the start signal detection unit detects the gate drive signal outputted by the last row of shift register unit included in each stage of gate drive circuit unit includes: detecting, by the start signal detection unit, the first start signal outputted from the left side gate drive sub-circuit of the stage of gate drive circuit unit to the left side gate drive sub-circuit included in the next stage of gate drive circuit unit adjacent to the stage of gate drive circuit unit, and the second start signal outputted from the right side gate drive sub-circuit of the stage of gate drive circuit unit to the right side gate drive sub-circuit included in the next stage of gate drive circuit unit adjacent to the stage of gate drive circuit unit.

The step in which the gamma main voltage setting unit sets the gamma main voltage based on the start signal may include: setting, by the gamma main voltage setting unit, the gamma main voltage based on the first start signal and the second start signal.

In the display adjusting method according to preferred embodiments of the present disclosure, the start signal detection unit detects the first start signal transmitted between adjacent stages of left side gate drive sub-circuits and the second start signal transmitted between adjacent stages of right side gate drive sub-circuits, and the gamma main voltage is set by the gamma main voltage setting unit based on the first start signal and the second start signal. In this case, the deficiency of lateral screen-splitting of display panel caused by different gate drive circuit units or caused by other factors can be solved even if the first start signal is different from the second start signal.

The above are merely the preferred embodiments of the present disclosure. It should be noted that, a person skilled in the art may make some improvements and modifications without departing from the principle of the present disclosure, and these improvements and modifications shall also fall within the scope of the present disclosure.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A display adjusting device for adjusting displaying of a display panel, comprising:

a start signal detection circuit, configured to, in a case that a gate drive circuit comprising a plurality of stages of gate drive circuit units scans a plurality of rows of gate lines arranged in the display panel, detect a gate drive signal outputted by each stage of gate drive circuit unit, wherein the gate drive signal serves as a start signal of a next stage of gate drive circuit unit adjacent to the stage of gate drive circuit unit, and the gate drive signal of the last stage of gate drive circuit unit serves as the start signal of the first stage of gate drive circuit unit; and a gamma main voltage setting circuit, configured to convert the start signal of each stage of gate drive circuit unit into a corresponding gamma main voltage.

2. The display adjusting device according to claim 1, further comprising: a plurality of start signal detection lines, wherein one end of each of the start signal detection lines is connected to the start signal detection circuit, and the other end of each of the start signal detection lines is connected to one corresponding stage of gate drive circuit units, wherein the start signal detection circuit is configured to detect gate drive signals outputted by respective stages of gate drive circuit units via the plurality of start signal detection lines.

3. The display adjusting device according to claim 1, wherein each stage of gate drive circuit unit comprises a left side gate drive sub-circuit and a right side gate drive sub-circuit that have a same structure and are respectively arranged on two lateral edges of the display panel, the left side gate drive sub-circuit comprised in the stage of gate drive circuit unit is configured to output a first start signal to the left side gate drive sub-circuit comprised in a next stage of gate drive circuit unit adjacent to the stage of gate drive circuit unit, the right side gate drive sub-circuit comprised in the stage of gate drive circuit unit is configured to output a second start signal to the right side gate drive sub-circuit comprised in the next stage of gate drive circuit unit adjacent to the stage of gate drive circuit unit, and the start signal detection circuit is configured to detect the first start signal and the second start signal when the gate drive circuit scans the plurality of rows of gate lines arranged in the display panel; and the gamma main voltage setting circuit is configured to set the corresponding gamma main voltage based on the first start signal and the second start signal.

4. The display adjusting device according to claim 1, wherein start signal transmission lines are arranged between each stage of gate drive circuit unit and a next stage of gate drive circuit unit adjacent to the stage of gate drive circuit unit and between a last stage of gate drive circuit unit and a first stage of gate drive circuit unit.

5. The display adjusting device according to claim 3, wherein the first start signal outputted by the left side gate drive sub-circuit comprised in each stage of gate drive circuit unit is same as the second start signal outputted by the right side gate drive sub-circuit comprised in the stage of gate drive circuit unit.

6. A power source circuit, comprising the display adjusting device according to claim 1.

7. The display adjusting device according to claim 1, wherein the start signal detection circuit and the gamma main voltage setting circuit are arranged on a power source circuit of the display panel.

8. A display device, comprising a display panel, a gate drive circuit and a power source circuit, wherein the gate drive circuit is configured to scan a plurality of rows of gate lines arranged in the display panel and comprises at least two stages of gate drive circuit units arranged in sequence along a longitudinal direction from the top to the bottom of a lateral edge of the display panel, and the power source circuit comprises a display adjusting device;

wherein the display adjusting device comprises:

a start signal detection circuit, configured to, in a case that the gate drive circuit scans the plurality of rows of gate lines arranged in the display panel, detect a gate drive signal outputted by each stage of gate drive circuit unit, wherein the gate drive signal serves as a start signal of a next stage of gate drive circuit unit adjacent to the stage of gate drive circuit unit, and the gate drive signal of the last stage of gate drive circuit unit serves as the start signal of the first stage of gate drive circuit unit; and a gamma main voltage setting circuit, configured to convert the start signal of each stage of gate drive circuit unit into a corresponding gamma main voltage.

9. The display device according to claim 8, wherein the display adjusting device further comprises a plurality of start signal detection lines that are connected to the start signal detection circuit, wherein one end of each of the start signal detection lines is connected to the start signal detection circuit, and the other end of each of the start signal detection lines is connected to one corresponding stage of gate drive circuit units, wherein the start signal detection circuit is configured to detect, via the plurality of start signal detection lines, gate drive signals outputted by respective stages of gate drives circuit units.

10. The display device according to claim 9, wherein each stage of gate drive circuit unit comprises a left side gate drive sub-circuit and a right side gate drive sub-circuit that have a same structure and are respectively arranged on two lateral edges of the display panel;

the left side gate drive sub-circuit comprised in the stage of gate drive circuit unit is configured to output a first start signal to the left side gate drive sub-circuit comprised in a next stage of gate drive circuit unit adjacent to the stage of gate drive circuit unit;

the right side gate drive sub-circuit comprised in the stage of gate drive circuit unit is configured to output a second start signal to the right side gate drive sub-circuit comprised in the next stage of gate drive circuit unit adjacent to the stage of gate drive circuit unit;

the start signal detection circuit is configured to detect the first start signal and the second start signal when the gate drive circuit scans the plurality of rows of gate lines arranged in the display panel; and the gamma main voltage setting circuit is configured to set the corresponding gamma main voltage based on the first start signal and the second start signal.

11. The display device according to claim 8, further comprising a source drive circuit, wherein the source drive circuit comprises a gamma reference voltage generation circuit configured to generate a gamma reference voltage based on the gamma main voltage.

12. A display adjusting method applied in a display device, wherein the display device comprises a display panel, a gate drive circuit and a power source circuit, the gate drive circuit is configured to scan a plurality of rows of gate lines arranged in the display panel and comprises at least two stages of gate drive circuit units arranged in sequence along a longitudinal direction from the top to the bottom of a lateral edge of the display panel, and the power source circuit comprises a display adjusting device; the display adjusting device comprises: a start signal detection circuit, configured to, in a case that the gate drive circuit scans the plurality of rows of gate lines arranged in the display panel, detect a gate drive signal outputted by each stage of gate drive circuit, wherein the gate drive signal serves as a start signal of a next stage of gate drive circuit unit adjacent to the stage of gate drive circuit unit, and the gate drive signal of the last stage of gate drive circuit unit serves as the start signal of the first stage of gate drive circuit unit; and a gamma main voltage setting circuit, configured to convert the start signal of each stage of gate drive circuit unit into a corresponding gamma main voltage, wherein the display adjusting method comprises:

scanning, by the gate drive circuit, the plurality of rows of gate lines arranged in the display panel, and detecting, by the start signal detection circuit, the gate drive signal outputted by each stage of gate drive circuit unit; and converting, by the gamma main voltage setting circuit, the gate drive signal of each stage of gate drive circuit unit into the corresponding gamma main voltage.

13. The display adjusting method according to claim 12, further comprising: generating, by a source drive circuit of the display panel, a gamma reference voltage based on the gamma main voltage.

14. The display adjusting method according to claim 12, wherein the step of scanning, by the gate drive circuit, the plurality of rows of gate lines arranged in the display panel comprises:

when the gate drive circuit scans a last row of gate line arranged in the display panel, outputting the gate drive signal from a last stage of gate drive circuit unit to a first stage of gate drive circuit unit as the start signal of the first stage of gate drive circuit unit.

15. The display adjusting method according to claim 12, wherein each stage of gate drive circuit unit comprises a left side gate drive sub-circuit and a right side gate drive sub-circuit that have a same structure and are respectively arranged on two lateral edges of the display panel, the left side gate drive sub-circuit comprised in the stage of gate drive circuit unit is configured to output a first start signal to the left side gate drive sub-circuit comprised in a next stage of gate drive circuit unit adjacent to the stage of gate drive circuit unit, the right side gate drive sub-circuit comprised in the stage of gate drive circuit unit is configured to output a second start signal to the right side gate drive sub-circuit comprised in the next stage of gate drive circuit unit adjacent to the stage of gate drive circuit;

wherein the step of detecting, by the start signal detection circuit, the gate drive signal outputted by each stage of gate drive circuit comprises:

detecting, by the start signal detection circuit, the first start signal outputted from the left side gate drive sub-circuit comprised in the stage of gate drive circuit unit to the left side gate drive sub-circuit comprised in the next stage of gate drive circuit unit adjacent to the stage of gate drive circuit unit and the second start signal outputted from the right side gate drive sub-circuit comprised in the stage of gate drive circuit unit to the right side gate drive sub-circuit comprised in the next stage of gate drive circuit unit adjacent to the stage of gate drive circuit unit; and wherein the step of setting, by the gamma main voltage setting circuit, the corresponding gamma main voltage based on the start signal comprises:

setting, by the gamma main voltage setting circuit, the corresponding gamma main voltage based on the first start signal and the second start signal.

* * * * *